United States Patent [19]

Dumbeck

[11] 4,333,268

[45] Jun. 8, 1982

[54] ENERGY SAVING ELECTRICALLY ACTUATED BARRIER GATE CONTROL MEANS OPERABLE FROM SOLAR ENERGY

[76] Inventor: Robert F. Dumbeck, P.O. Box, Elgin, Tex. 78621

[21] Appl. No.: 127,233

[22] Filed: Mar. 4, 1980

[51] Int. Cl.[3] ..... E01F 13/00

[52] U.S. Cl. ..... 49/34; 49/58; 49/280; 429/8

[58] Field of Search ..... 49/34, 58, 135, 131, 49/280, 93; 136/89 AC

[56] References Cited

U.S. PATENT DOCUMENTS

| | | | |
|---|---|---|---|
| 1,468,471 | 9/1923 | Harsen | 49/280 |
| 1,529,744 | 3/1925 | Keenan | 49/34 |
| 1,642,875 | 9/1927 | Fitch et al. | 49/34 X |
| 1,665,157 | 4/1928 | Dahnke | 49/93 X |
| 2,170,467 | 8/1939 | Anderson | 49/93 X |
| 3,022,590 | 2/1962 | Ohlhausen | 49/58 |
| 4,108,405 | 8/1978 | Gibson | 136/89 AC |

*Primary Examiner*—Kenneth Downey
*Attorney, Agent, or Firm*—Laurence R. Brown

[57] ABSTRACT

A road barrier system prevents automobile access by means of a chain array or swinging gate held in place across a roadway between two posts. A motor driven mechanism operates the barrier in response to a key or security access code in two modes of operation, one being open access and the other automatically opening and reclosing the gate after a preset time period.

Features include quick operation, energy efficiency, self-powered solar energy as the sole energy input, breakaway features to prevent serious damage to the control equipment upon unauthorized entry by force and high-reliability low-maintenance simple equipment useful in country locations without access to power line energy sources. In this respect, the barrier in one embodiment is built as a part of a cattle guard assembly.

19 Claims, 6 Drawing Figures

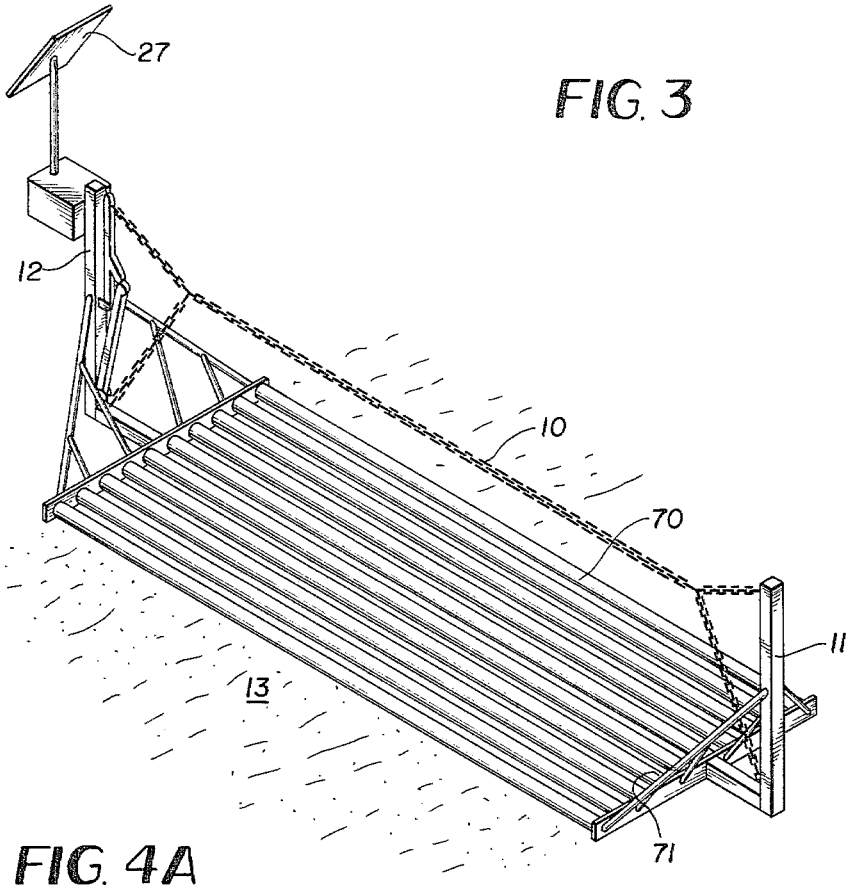
FIG. 3
FIG. 4A
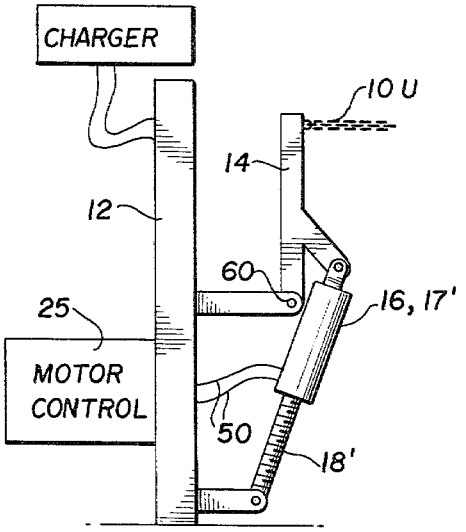
FIG. 4B
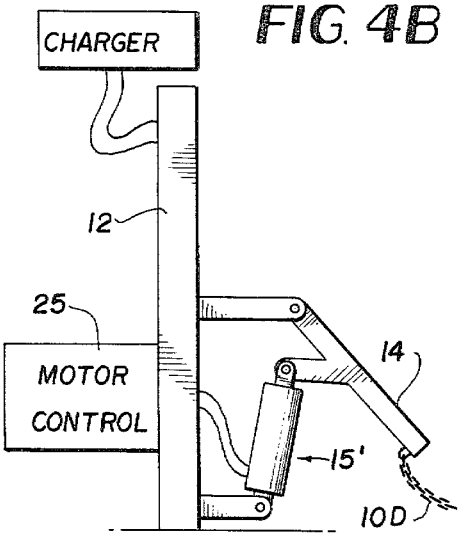

ENERGY SAVING ELECTRICALLY ACTUATED BARRIER GATE CONTROL MEANS OPERABLE FROM SOLAR ENERGY

TECHNICAL FIELD

This invention relates to barrier gates for limiting access to automotive traffic and more particularly it relates to access gates opened and closed by electric motors.

BACKGROUND ART

Access control gates are well known in the art. In some of the prior art chains or similar flexible lines are lowered or drooped from a position barring access to automotive traffic or the like to a position on the roadway over which the traffic can pass.

For example, U.S. Pat. No. 1,642,875—Fitch et al., Sept. 20, 1927 has a manually operated block and tackle array for raising and lowering a chain barrier. This is not well adapted for motor control and the complex threading of the mechanism provides a ready source of failure by knotting or fraying.

Even earlier U.S. Pat. No. 484,572—Rudert, Oct. 18, 1892 has an underground winch array for engaging chain links to tighten and loosen a single chain line across a roadway in response to rotation of an underground manually driven gear assembly. This is expensive in construction and installation.

A single chain line barrier in U.S. Pat. No. 2,663,103—Ellison, Dec. 22, 1953 is pulled between lowered and raised positions by a hydraulic cylinder mechanism. This patent discloses an automatic control system which opens in response to payment of a toll and which closes automatically as a vehicle leaves the barrier. A very limited range of movement is provided without a very long hydraulic cylinder.

A further chain line barrier is shown in U.S. Pat. No. 1,790,304—House, Jan. 27, 1931 where a lever arm and eccentric pully wheel are rotated manually between a latching and release position for a chain gate barrier array.

There are several deficiencies of such prior art systems however. For example, it has not been heretofore feasible to provide automatic electrically operable barrier gates at unattended country locations where there is no access to power lines, to keep automobile traffic selectively out of farms, cottages, etc.

Significant problems in this respect have not been overcome, since reliable battery operation requires low energy in use to control gate access and need be combined with an appropriate gate barrier. Thus, the flexible line or chain barrier gate is feasible to use, but the prior art mechanisms are not adaptable to the remote electrical operation because high battery drain would not be an acceptable condition and would result in down-time need to recharge and/or replace batteries often and thus would not overcome the lack of available operating power.

Furthermore, it is an object of this invention to attain the improved feature of energy saving and operation solely from solar energy.

When low power battery operation is employed other problems appear that are not recognized or solved in the prior art. For example, the line must be handled in such a way that it is held taut and reasonably high off the ground to produce a substantial barrier deterrant that can be seen readily by a motorist over an automobile hood. Otherwise, the barrier may be broken down forcefully by unauthorized entries.

In the event of such unauthorized entry it is also desirable, even if significant damage is induced to the front end of a vehicle driven through the barrier, there should be no significant damage to the barrier entry system. The prior art provides no effective means for this feature.

Also if a barrier is installed in a limited usage country location it need be simple enough to operate under all conditions encountered with little need for repair or maintenance. Thus, complex chain or flexible line handling mechanisms, which could jam or mishandle the line during the rather large range of movement necessary to drop a line from non-access position generally parallel to the roadway to a position on the roadway which can be driven over, are not tolerable, nor are slowly actuated systems which require more power to move heavy barriers.

Also it is most desirable to provide a reliable and effective system at reasonable cost.

Thus, it is a general objective of this invention to overcome the foregoing disadvantages of the prior art and to have features achieving further advantages such as will be found throughout the following description, drawings and claims.

DISCLOSURE OF THE INVENTION

This invention provides road barrier access control means for a chain or flexible line barrier held between posts placed across a roadway. The chain barrier is constructed for instantaneous opening and rapid closing as controlled by a chain control lever arm pivoted about midway on one post and movable between a substantially vertical position pointing upwardly and a substantially vertical position pointing downwardly.

The chain barrier has a single line positioned substantially parallel to the roadway at a level corresponding to the upper half of the post height and the terminal ends are connected to a line section at each end which forms with the post a substantially triangular array with the line erected in its barrier position. This permits fast collapse without fouling or threading and retains the chain in its downward position on the roadway across most of the distance between the posts as the lever arm is rotated downwardly.

To keep the chain taut and in place, a brace pivot arm rotates about a pivot near the bottom of the post and in its upper position it interlocks with and braces the chain control lever arm. This latter lever arm is pivoted to move the chain control lever arm between its up and down positions by means of a battery operated motor drive mechanism.

The motor is controlled by a lock, key, code or other access condition to operate only when the gate barrier is lowered or raised. Thus, the gate is opened in one control mode when it is desirable to leave it open. In another automatic control mode, the gate is lowered and then automatically raised after a built-in time delay.

A low-power low-battery-drain system is thus afforded that is coupled with a solar energy cell to charge the battery and self power the system solely by solar energy.

A break-away chain control lever arm construction prevents damage to the mechanism in the event an automobile drives through the barrier.

Alternatively a swinging gate barrier may be moved with the gate control means from open to closed and latched position.

BRIEF DESCRIPTION OF THE DRAWINGS

In the drawings

FIG. 3 is a roadside view of a barrier system of this invention controlling a country lane as part of a cattle guard assembly;

FIGS. 4A and 4B are respective sketches of a preferred gate control mechanism in closed and open gate positions;

DETAILED DESCRIPTION OF A PREFERRED EMBODIMENT

Figure 1:
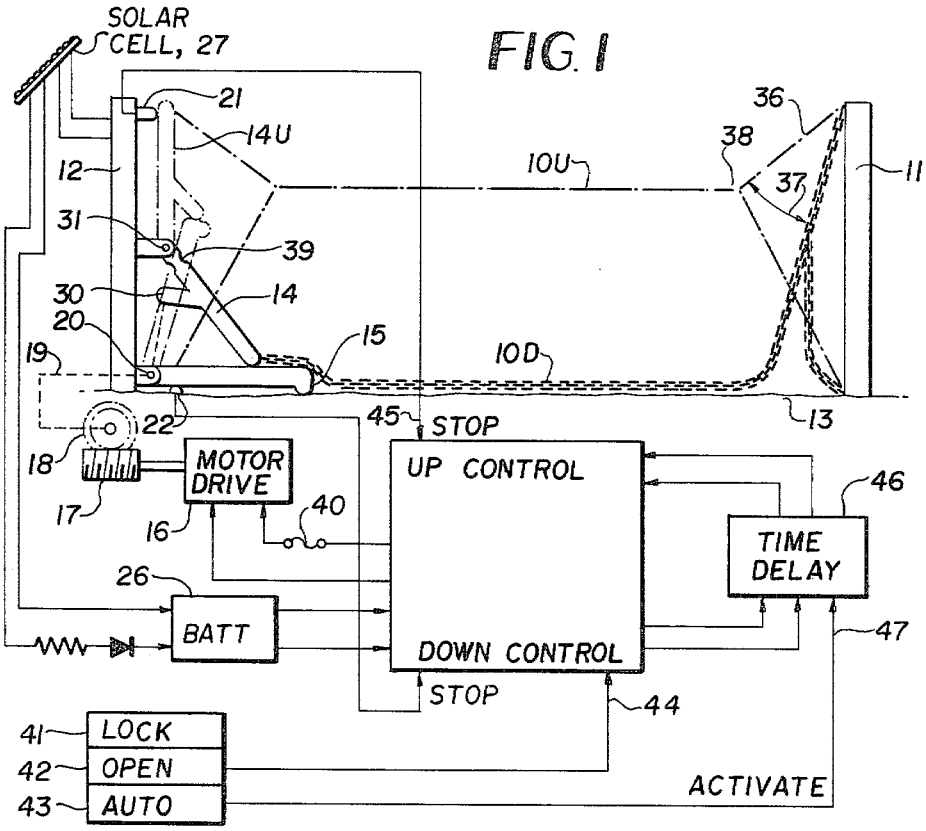
FIG. 1 is an elevation sketch of a road barrier coupled with a block control diagram illustrating the road barrier access control system afforded by this invention.

The road barrier mechanism is shown in FIG. 1, wherein a chain 10 or equivalent flexible line is disposed between two posts 11 and 12 to extend across a roadway 13. The upper or barrier position of the chain (10U) is shown in phantom and the lower or access position of the chain (10L) is shown to rest primarily upon the roadway 13 so that an automotive vehicle, or the like, may be driven over it.

The mechanism for raising and lowering the chain barrier is essentially two pivoted levers 14, 15 and a motor 16 with a drive train typically worm 17 and pivoting gear 18, which as shown by dash line 19 is coupled to pivot lever 15 to rotate it in both clockwise and counterclockwise directions within upper and lower limits about pivot point 20 located near the bottom of post 12. The remainder of the system comprises an electrically operable control configuration for driving the motor 16 only when the gate chain barrier 10 is in the dynamic condition of being lowered or raised.

The interface between the mechanism and the electrical control system therefore comprises the motor and two interlock switches 21, 22 that respectively indicate the upper rest position (14U) of barrier positioning lever 14, and the lower rest position (14L) of the actuating and bracing lever 15. That is, the switches 21, 22 indicate when the gate is fully open or fully closed, and thus serve to monitor and control the operation system 25 by stopping the motor in the up gate position and down gate position. In this fashion, no energy is used in the quiescent state from the operating battery 26, which therefore can supply all the energy solely from the charging of solar cell 27 for operation of the system within a reasonable rate of operating cycles such as 15 per day.

In the gate actuating mechanisms, it is seen that the gate positioning lever arm 14 has a mechanical interlock extension arm 30 which engages the outer head of the actuating and bracing lever 15 in its upper counterclockwise limiting position where it generally points upwardly and holds the chain 10U tautly across the roadway 13 as braced and locked by the interengagement of lever arms 14, 15 as shown in phantom view. The upper lever arm 14 is pivoted at a position 31 near the mid-height position of the post 12 to swing from its two terminal limiting positions respectively pointing upwardly 14U and downwardly where the chain assembly 10 it carries will respectively be closed and opened.

The lever arm 14U will pivot clockwise downwardly as lever 15 is pivoted clockwise until it reaches the terminal position 14 shown where it points generally downwardly. This then will let the section of chain 36 which is connected to the terminal end 38 of the chain 10U pivot the end 38 through an arc 37 so that the chain will rest on the ground over a wider portion of roadway 13 in a motion that will not tend to knot or tangle the barrier line and which will permit it to be very quickly lowered and raised with little power.

To move lever 14 counterclockwise upward into position 14U, the lever 15 is pivoted by gear 18 counterclockwise until the head of lever 15 is interlocked in arm 30 and interlock 21 stops the drive motor 16. Conversely when the barrier chain 10D is down, the interlock 22 keeps the motor inoperative until such time as an up control signal overrides this interlock by action of the control system 25. Similarly the gate barrier 10U is lowered by overriding the interlock 21. It is noted that the motor in the up and down modes will be reversed and thus the d-c motor operable from battery 26 is reversible. The worm 17 also meshing in gear 18 gives stability and support to the lever 15 in the bracing position and prevents any dislodging of the lever 15 to lower the gate without operation of the motor 16. The motor 16 is fused at 40 to protect it and the battery 26 in the event anything jams or the interlocks 21, 22 fail.

The lever arm 14 is provided with a break-away feature, illustrated by the restricted area portion 39. Thus, if an unauthorized vehicle drives through the barrier, the arm will break off and the operating mechanism will not be seriously damaged. The chain 10 is preferably at a level easily seen, and stretched taut to position it above the bumper area of a vehicle. Thus, it can inflict damage to the front grillwork upon a vehicle attempting to drive through.

It is evident therefore that the motor can be controlled to drive the gate up or down as desired. The initiation of any motor cycle is under control of an access condition or signal which may simply be a locked key 41 or any other coded security device that will mechanically or electrically condition the respective switches 42, 43 to operate the system in gate open or automatic open-close cycle modes as selected by manual operation of the corresponding switch 42, 43.

Thus the gate open switch 42 serves to start the down control function of control circuit 25 as indicated schematically at single lead 44, by overriding the effect of interlock switch 21 otherwise holding the motor 16 inactive at the control lead 45. The automatic cycle obtained by means of selection of switch 43 will actuate both the start condition 44 to open the gate and a time delay circuit 46 by medium of lead 47. Then a preset time such as forty-five seconds after the down controls are operated the up controls will be actuated automatically to return the barrier into security position.

Figure 2:
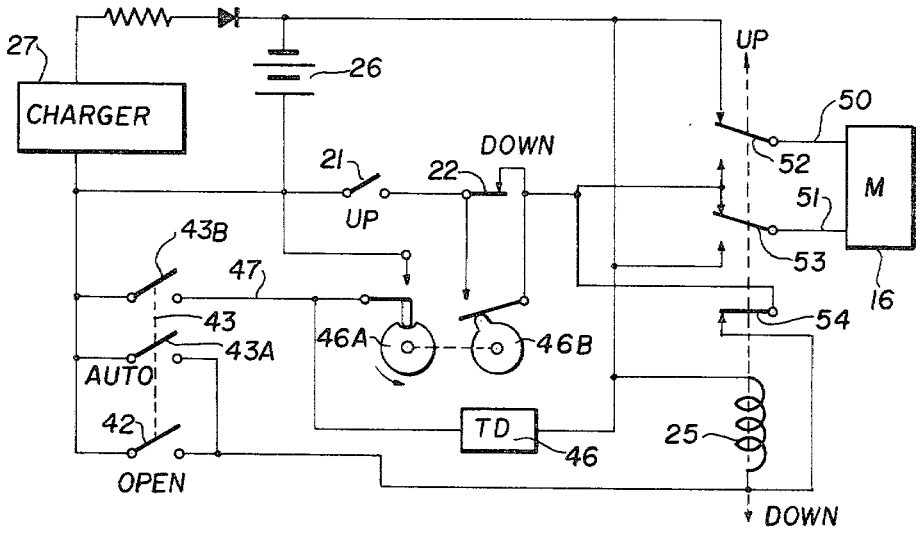
FIG. 2 is a schematic diagram of an electrical control circuit affording energy efficient operation powered by solar energy as provided by this invention.

A relay operated circuit embodiment of the electrically actuated gate control system is shown in FIG. 2. Similar reference characters are used for corresponding features for purpose of comparison. This circuit is shown in the barrier up position and represents a simple low energy consumption circuit which makes feasible the use of the solar cell 27 to supply all the necessary energy. Equivalent electronic circuits may be used as desired in place of the relay and time delay device to perform the various functions.

Since the motor 16 is a d-c motor it will run in a direction determined by the polarity of the battery 26. Thus the control relay 25 serves to reverse the battery polarity at motor leads 50, 51 thereby producing a gate up direction of polarity in the uppermost unenergized position of the contacts as shown. In this gate condition the upper interlock 21 is opened to show the barrier gate is closed and the lower interlock 22 is closed. A particular advantage of this circuit condition is that there is no battery discharge in the quiescent condition when the gate is down or up, and there are few components to fail or use energy during the dynamic transition periods.

The security locks for the switches 42, 43 are not shown, but they are preferably controlled by a lock or other coded security device so that access is limited to those authorized persons having the appropriate access code.

In the open mode of operation, the switch 42 will actuate relay 25 to move its set of contacts 52, 53, 54 downwardly into the gate opening dynamic mode by completing a circuit across the battery 26 through the actuating coil of relay 25, thus actuating motor 16 to turn in the direction lowering the barrier. The motor 16 is held in actuated condition by relay 25 through its holding contact set 54 until the interlock 22 is opened by the gate mechanism when the barrier is down, and the roadway passable.

The momentary contact open switch 42 is actuated manually long enough for the motor 16 to move the mechanism away from the barrier up position thereby closing up interlock switch 21 so that holding contact 54 is effective to keep relay 25 energized until the gate down interlock 22 is opened when the relay is released and the motor is primed for a gate up cycle. Thus the gate remains open without any expenditure of energy in the control circuit, and the motor 16 and relay 25 are only energized long enough to open the barrier.

To close the gate the automatic cycle switch 43 may be used. This switch by way of contact set 43A in the automatic mode also similarly effects the opening cycle just described in the event the gate is up and down interlock 22 is closed.

In addition, the automatic switch contact set 43B actuates a time delay device such as the one shown where a motor turns cams 46A, 46B counterclockwise to operate the corresponding switch sets. Thus the momentary actuated manual switch 43B is held down manually long enough for the holding switch set 46A to close as the rider emerges out of the cam slot. Then for a preset time, such as forty-five seconds, it takes for one full revolution of the cams, the timing motor will run and just before the end of that time the contact set operated by cam 46B closes. This will then override the down interlock 22 which is open when the barrier is down. Thus energizing the motor 16 which closes the barrier when the gate is closed, up interlock 21 will be opened as shown thereby deenergizing the motor and resetting the circuit in an unenergized condition awaiting the next open or automatic command at switches 42, 43. The time delay mechanism 46 is also deenergized by return of the switch set at cam 46A into the notch. Other control circuit variations can be used to operate the system but the mode of operation just described, which critically uses energy only while the barrier gates are in a dynamic condition of being raised or lowered, permits the use of solar cell 27 to supply the entire energy for the system for a reasonable number of gate open-close cycles such as fifteen per day.

FIG. 3 shows a typical country installation where this system is most effective because access to power lines for operating electrical circuits is not feasible. Even where feasible the cost of installing a power line connection and meter to a security gate may be prohibitive. Thus, the self powered, battery operated system herein provided is useful in many locations and has significantly advanced the state of the art. It is also most advantageous for use on farms and ranches to have the posts 11 and 12 built in as an integral part of a cattle guard assembly 70, where the bracing members 71 give strength and support to the posts 11, 12 and thus effectively cooperate with the chain 10 to prevent unauthorized entry of a vehicle on the roadway 13.

Figure 5:
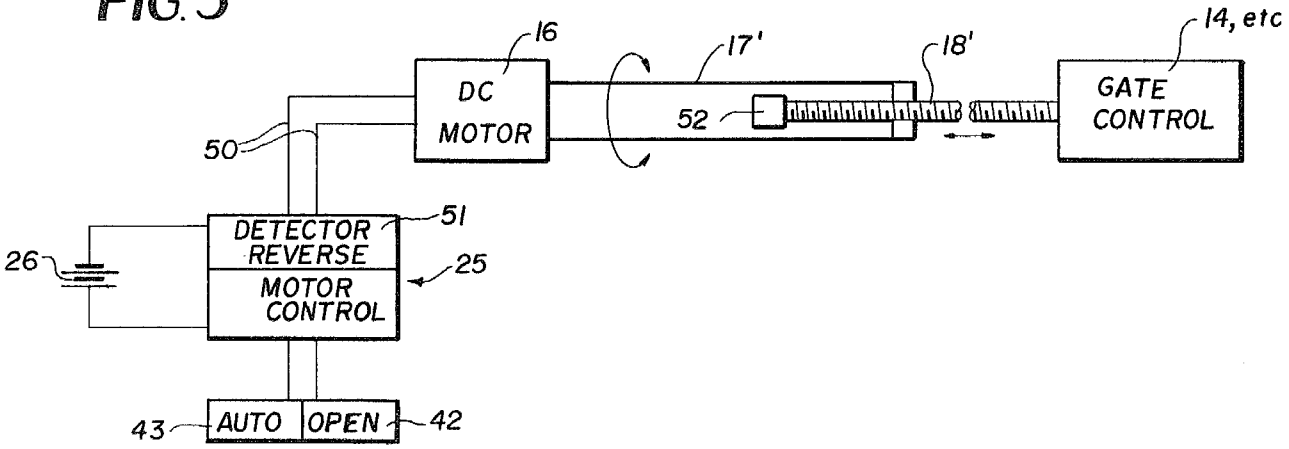
FIG. 5 is a diagrammatic and electrical block control diagram of the motor drive arrangement of FIG. 4.

A preferred embodiment of the motor driven gate actuating mechanism is shown in FIGS. 4 and 5. Thus the pivoted lever 15 hereinbefore described is modified as indicated by reference character 15' to contain the motor drive 16 and mechanism 17', 18' for operating the pivoted lever 14 or similarly actuated pivoted gate barrier shown in FIG. 6. Control circuits 25, etc. as before described control the reversible d-c motor from the manual switches 42, 43. The battery 26 is charged environmentally from charger 27' which is preferably a solar cell or wind actuated generator unit so that the system is self powered for use in locations without power line connections.

As seen from FIG. 5, if the motor 16 drives tube 17' or equivalent at a proper speed determined by a gear box in motor 16 if necessary, then screw gear 18' will be extendable or retractible depending upon motor direction. Thus, as seen in FIG. 4A, when the screw 18' is extended, the lever 14 is up and the chain 10U is taut to close the gate. Conversely when the screw 18' is retracted, lever 14 moves downwardly to place chain 10D on the ground to open the gate. The motor control wires 50 lead to the motor control system 25, etc. which is operable in the manner before described.

It is noted, however, that the open and closed gate limits are preferably electronically detected by means of reversing detector 51 which operates to sense increasing motor current, which increases when the motor load is increased by closing the lever 14 against stop 52 or conversely by opening the gate where limiting down position of the motor in FIG. 4B will increase the motor current in leads 50, thus to provide a reversing signal at either end of gate travel.

Figure 6:
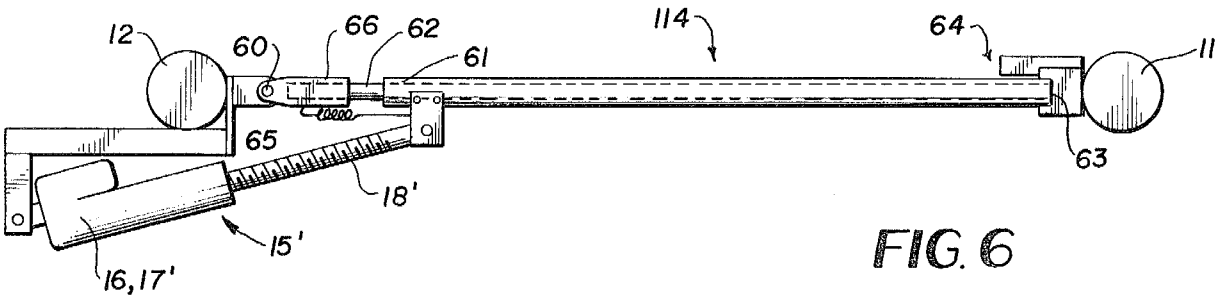
FIG. 6 is a top diagrammatic view of a swinging gate embodiment of the invention.

This same mechanism can be used to open and close a swinging or pivoted gate barrier such as shown in FIG. 6 where the pivoted lever becomes the swinging gate barrier 114 positioned between posts 12 and 11 as seen from the top view. The gate 114 is swung about pivot axis 60 in the same manner as described in FIG. 4.

In this embodiment an automatic latching operating is provided by the slidable sleeve 61 disposed upon shaft 62. This sleeve locks into groove 63 at post 11 after the gate 114 is swung closed to reach the stop 64 when the sleeve 61 is urged to the right into the groove 63 by the pivoted motor-thread assembly 16, 17', 18'.

To unlatch the spring 65 aids the motor to dislodge the latch and prevents so much startup motor current as to actuate the reversing sensors. After the sleeve 61 hits shoulder 66 the gate 114 is swung clockwise in the manner shown in FIG. 4B until fully open letting a vehicle pass through the controlled roadway.

It is evident from the foregoing specification that this invention has provided an efficient and improved road barrier access system with various novel features. Thus, those features of novelty believed patentably descriptive of the spirit and nature of this invention are defined with particularity in the claims.

Industrial Application

A road barrier system for automobile traffic is operated by an access condition such as a key to drop a barrier chain assembly to the ground or pivot a gate barrier open so that an automobile may pass. Two modes of operation, (1) a selective open rest condition or (2) an automatic mode reclosing the barrier after a preset time period are provided.

The system is energy efficient and operates solely from solar energy which charges a battery operating the barrier closure motor and the control system therefor. Accordingly, the system may be installed in remote country locations or other places where power lines are not available or would be inexpensive or inconvenient to connect. A preferred farm or ranch embodiment has the barrier access system installed upon a cattle guard arrangement.

I claim:

1. A self powered environmental energy operated barrier access gate assembly, comprising in combination, a gate assembly with a barrier movable into open and closed positions for prevention of automotive traffic therethrough in closed position, a reversible d-c motor, a gate actuating mechanism powered thereby comprising a motor driven gear coupled for pivoting a single pivotable lever arm connected to the gate assembly for thereby moving the gate barrier between said open and closed positions, an electric control system actuating said motor for moving the gate to selected ones of said open and closed positions in respective forward and reverse motor directions, a d-c battery power supply with an environmental energy producing device coupled to said power supply to recharge the battery, and circuitry connecting said motor and control system to derive all operating power thereto from environmental energy by way of said rechargeable battery.

2. The assembly defined in claim 1 wherein the control system is provided with interlocks removing power when the gate resides in either open or closed condition, thereby to use power only when the gate is being opened and closed by the motor.

3. The combination defined in claim 2 wherein the gate assembly is mounted between two post assemblies on opposite sides of a roadway, further comprising a cattle guard comprising a portion of the roadway between said post assemblies with the posts integrally affixed to the cattle guard.

4. The combination defined in claim 1 wherein the gate assembly comprises a chain.

5. The combination defined in claim 1 further comprising a lever operable from a motor actuating a screw mechanism to open said gate assembly and means to automatically return the lever to a gate closure position a predetermined time period after the gate is opened by moving said lever.

6. An assembly as defined in claim 1 wherein the energy producing device is a solar cell.

7. The combination defined in claim 1 wherein the gate assembly comprises a pivoted barrier member.

8. The combination defined in claim 7 including locking means operable by said motor for locking the pivoted barrier in closed position.

9. The combination defined in claim 8 wherein the locking means comprises a slidable locking member movable on said barrier member under control of said motor at a limit position when the barrier member is closed.

10. The combination defined in claim 1 wherein the gate actuating mechanism comprises said pivotable lever with a motor and motor driven extension screw mechanism therein coupled to pivot a gate barrier member between limiting positions in said opened and closed positions.

11. The combination defined in claim 10 wherein motor stop means is provided for both open and closed gate positions, and including limit stop means detecting motor load increases when the stop means are encountered to terminate either a closed and open gate cycle.

12. The combination defined in claim 11 including means reversing the motor direction in response to each limit stop means detection, thereby to automatically direct a closed gate to open and an open gate to close.

13. The combination defined in claim 1 wherein said control means is responsive to an access condition for moving said gate from closed to open conditions, and including manually operable switching circuit means automatically restoring the gate to closed condition a predetermined time after manual actuation thereof.

14. The system defined in claim 11 including manually operated gate control switching means connected with said control means selectively to initiate an operation mode opening said gate and keeping it open for a predetermined time period until said switching circuit restores automatic operation.

15. The combination defined in claim 1 further comprising, a pair of post assemblies for mounting on opposite sides of a roadway to support barrier means across the roadway, a flexible line constituting said gate assembly attachable to the two posts for disposal between them at a position above the roadway and substantially parallel therewith at a level that would engage an automobile to thereby serve as a barrier for automobile through traffic, means engaging the terminal end of said line to one said post, a lever arm movable on the other said post in an arc from a substantially vertical position adjacent the post pointing upwardly to a substantially vertical position adjacent the post pointing downwardly, means engaging the other terminal end of said line at the end of said lever arm to move the line from said parallel position when the lever is pointing upwardly to a position residing on the roadway when the lever is pointing downwardly, thereby permitting an automobile to pass the barrier in only the latter position, and means coupling said gate actuating mechanism for moving said lever between said two positions in response to an access condition supplied by a driver desiring access through the barrier.

16. The combination defined in claim 1 further comprising a break-away mechanism permitting the gate assembly to give way from the actuating mechanism if a vehicle drives through the barrier.

17. The combination defined in claim 1 wherein said gate assembly comprises means disposed parallel to the roadway such as a chain line disposed between two posts with the line adapted to be stretched taut for barring access and to be dropped to the ground for permitting access and being connected at terminal ends to a line section connected from near the bottom of each post to a position near the top of each post when the line is in its upper barrier position, wherein the line section forms with each post in the barrier position a substantially triangular array meeting the parallel line at a position within the upper half of the post dimension.

18. An electrical actuation system for operating a barrier access gate assembly movable between open and closed conditions in response to an electrical control signal, comprising a d-c reversible motor, a screw mechanism rotated in two opposite directions by said motor to move back and forth for moving said gate respectively toward said open and closed positions, and a single pivotable lever moved back and forth by movement of said screw mechanism therewith opening and closing the barrier access gate assembly.

19. The combination defined in claim 18 including means for mechanically loading the motor at gate open and gate closed positions, and detection means for signalling increased motor load coupled to said automatic control means for changing motor direction.

* * * * *